United States Patent [19]

Vanderpool et al.

[11] 4,283,258

[45] Aug. 11, 1981

[54] RECOVERY OF TUNGSTEN FROM HEAVY METAL ALLOYS

[75] Inventors: Clarence D. Vanderpool, Towanda; Robert P. McClintic, Monroeton, both of Pa.

[73] Assignee: GTE Products Corporation, Stamford, Conn.

[21] Appl. No.: 163,467

[22] Filed: Jun. 27, 1980

[51] Int. Cl.[3] ..... C25B 1/00; C25B 5/00

[52] U.S. Cl. ..... 204/102; 204/146

[58] Field of Search ..... 204/102, 146

[56] References Cited

U.S. PATENT DOCUMENTS 2,872,394 2/1959 Newman ..... 204/146

*Primary Examiner*—R. L. Andrews

*Attorney, Agent, or Firm*—Robert E. Walter

[57] ABSTRACT

In a process for preparing ammonium paratungstate from a heavy metal alloy, the metal alloy is introduced as an anode into an electrolytic cell containing an aqueous electrolyte solution comprising ammonium hydroxide and ammonium nitrate. Ammonium paratungstate is formed when a direct electric current is passed through the cell.

3 Claims, No Drawings

RECOVERY OF TUNGSTEN FROM HEAVY METAL ALLOYS

The present invention relates to the recovery of tungsten from heavy metal alloys. Heavy metal alloys are extensively used as shields or containers for radioactive materials, such as gyroscope rotors, counter weights, and corrosion resistant parts for jet air craft, and as penetrators for projectiles and rocket nose cones.

Such alloys are dense, hard corrosion resistant. Due to their nature, recovery of various valuable metal components is difficult. Typical recovery methods employing conventional acids, bases or other solvents are generally slow, expensive and otherwise generally ineffective from the standpoint of commercial operation. U.S. Pat. No. 2,716,558 to Hall describes a process for recovering nickel and copper from Monel metal by introducing the alloy into an aqueous solution of the strong inorganic acid, e.g. sulfuric, nitric or hydrochloric acid and passing sulfur dioxide into the solution.

U.S. Pat. No. 3,635,674 to Shwayder discloses a process for recovering refractory carbide particles from cemented carbides wherein an aqueous ammonia solution leaches cobalt binder from pieces of cemented refractory carbides so as to form the stable cobalt or nickel complexing solution and leaves a carbide particle free in their original form.

It is an object of the present invention to provide a process for economically and effectively recovering the constituents of the heavy metal alloys without the use of extremely concentrated inorganic acids and bases.

Other and further objects of the present invention will become apparent from reading the following description.

In accordance with the present invention, there is provided a process for producing ammonia paratungstate from a heavy metal alloy containing tungsten comprising introducing the heavy metal alloy into an electrolytic cell as an anode, said cell comprising an inert cathode and an aqueous electrolyte solution comprising ammonia hydroxide and ammonium nitrate, passing a direct electric current through said cell, said ammonium hydroxide and ammonium nitrate being maintained at a suitable concentration for oxidizing tungsten and forming ammonium paratungstate.

DETAILED DESCRIPTION

Heavy metal alloys which are desirably reclaimed consist essentially of tungsten metal dispersed throughout a matrix. Because of the high melting point, density and other physical properties, tungsten is an attractive metal for many articles of manufacture. However, pure tungsten requires high sintering temperatures and is too brittle for many applications. Typical matrix metals include chromium, iron, cobalt, nickel, copper and mixtures or alloys thereof. The matrix is distributed around the particles of tungsten for improving the mechanical properties of the heavy metal alloy.

Typical heavy metal alloys comprise from about 80 to about 95 percent tungsten and the remainder matrix material. Even more preferably, the heavy metal alloys comprise from about 87 to 93 percent tungsten. The preferred matrix material comprises nickel, iron, copper or an alloy thereof. Typical alloys are of nickel and copper or nickel and iron.

The original articles are generally fabricated by mixing the starting materials uniformly, compacting and sintering to above about 95 percent theoretical density by pressing. The blended powder may be loaded into a plastic bag and isostaticly pressed to form a compact. The pressures are in the order of about 10,000 psi to form a suitable compact. The compact is then sintered in a carbon free atmosphere in the range of at least 1,200° C. The sintering time necessary to reach the required densification varies with the sintering temperature. The article may be further work hardened to strengthen it for various applications.

In accordance with the present invention, there is provided a process for producing ammonium paratungstate from a heavy metal alloy containing tungsten comprising introducing the heavy metal alloy into an electrolytic cell as an anode, said cell comprising an inert cathode and an aqueous electrolyte solution comprising ammonium hydroxide and ammonium nitrate, passing a direct electric current through said cell, said ammonium hydroxide and ammonium nitrate being maintained at a suitable concentration for oxidizing tungsten and forming ammonium paratungstate.

The electrolytic cell utilized in the process of the present invention is the type having inert cathode formed from a suitable nonreactive electrode material such as graphite or a noble metal such as gold and platinum. The heavy metal alloy to be processed forms the anode or positive pole and is appropriately connected to a conventional source of direct current so that an electrical potential difference may be applied between the electrodes.

The anode and cathode are suspended in an aqueous electrolyte comprising ammonium nitrate and ammonium hydroxide. Ammonium hydroxide is present in a suitable amount to render the electrolyte sufficiently conductive to permit the passage of a sufficient amount of current through the cell. Generally, an increase in the ammonium hydroxide concentration will increase the speed of the dissolution of the tungsten and the anode due to increase conductivity of the electrolyte. Preferably, the aqueous electrolyte comprises from about 2 to about 15 percent by total weight ammonium hydroxide.

The aqueous electrolyte further comprises a sufficient amount of an oxidizing agent in the form of ammonium nitrate for oxidizing tungsten contained in the anode to a tungstate species. Preferably the aqueous electrolyte comprises from about 10 to about 30 percent ammonium nitrate based on the total weight of the electrolyte.

When a direct current is passed through the electrolytic cell, the anode materials comprising tungsten and matrix material dissolves into the electrolyte. As the process continues, the concentration of tungsten species and binder material species in the form of ammonium complexes increases in the electrolyte solution.

After the desired concentration of ammonium paratungstate is reached in the electrolyte solution, the reaction may be stopped and the electrolyte withdrawn. The resulting ammonium paratungstate may be purified by conventional methods known in the art.

The following examples are intended to illustrate the invention and are not intended to be limited thereof.

EXAMPLE 1

An electrolytic cell was formed from a 1,000 milliliter beaker having a stainless steel screen around the interior surface as a cathode. The electrolytic aqueous solution consisted of 200 cc of water, 200 cc solution of ammonium hydroxide, about 28 percent by weight, and 100 grams of ammonium nitrate. A 744.15 gram piece of heavy metal having the composition of about 90 percent tungsten, 6 percent nickel and 4 percent copper was suspended as the anode in the center of the beaker. The anode and cathode were connected to a direct current source and time, volts, amperage and temperature were monitored according to Table 1.

| Time (Minutes) | Volts | Amperes | Temperature |
|---|---|---|---|
| 0 | 6.0 | 18 | 25 |
| 5 | 6.0 | 28 | 29 |
| 8 | 6.0 | 30 | 52 |
| 12 | 6.0 | 28 | 63 |
| 23 | 6.0 | 32 | 84 |
| 32 | 6.0 | 37 | 92.5 |
| 35 | 6.0 | 25 | 93.0 |
| 37 | 6.0 | 18 | 93.0 |
| 38 | 7.0 | 13.0 | 92.0 |
| 40 | 7.5 | 5.0 | 92.0 |

At the end of the 12 minutes, a blue solution with a white precipitate was observed. After about 35 minutes it was observed that the current was dropping. At the end of 40 minutes it was determined that heavy metal had lost about 15 grams. At this point, 100 cc solution of ammonium hydroxide, about 28 percent by weight, was added to the electrolyte and the electrolysis was continued for three hours. About 100 cc of ammonium hydroxide solution was added approximately each hour during the three hour period. After each addition of ammonium hydroxide, the recorded amperage would increase. A total of 91.0 grams of material were removed from the electrode to give a dissolution rate of about 25 grams per hour. At the end of the additional three hour time period, the electrolyte was evaporated until a pH of approximately 7.0 was obtained. The blue-green crystals of ammonium paratungstate which precipitated contained copper, nickel, and iron as shown by spectographic analysis.

INDUSTRIAL APPLICABILITY

The present invention provides a method for reclaiming tungsten from tungsten containing heavy metal alloys in a form suitable for reuse.

We claim:

1. A process for producing ammonium paratungstate from a heavy metal alloy containing tungsten comprising introducing the heavy metal alloy into an electrolytic cell as an anode, said cell comprising an inert cathode and an aqueous electrolyte solution comprising ammonium hydroxide and ammonium nitrate, passing a direct electric current through said cell, said ammonium hydroxide and ammonium nitrate being maintained at a suitable concentration for oxidizing tungsten and forming ammonium paratungstate.

2. A process according to claim 1 wherein the aqueous electrolyte comprises from about 2 to about 15 percent by weight ammonium hydroxide.

3. A process according to claim 2 wherein the aqueous electrolyte comprises from about 10 to about 30 percent by weight ammonium nitrate.

* * * * *